US008906199B2

(12) United States Patent
Giles et al.

(10) Patent No.: US 8,906,199 B2
(45) Date of Patent: Dec. 9, 2014

(54) PROCESS FOR BLEACHING PULP

(75) Inventors: Matthew Robert Giles, Chester Cheshire (GB); Nicholas John Dixon, Chester Cheshire (GB)

(73) Assignee: Innospec Limited (GB)

( * ) Notice: Subject to any disclaimer, the term of this patent is extended or adjusted under 35 U.S.C. 154(b) by 215 days.

(21) Appl. No.: 12/740,120

(22) PCT Filed: Nov. 3, 2008

(86) PCT No.: PCT/GB2008/051027
§ 371 (c)(1),
(2), (4) Date: May 17, 2010

(87) PCT Pub. No.: WO2009/056893
PCT Pub. Date: May 7, 2009

(65) Prior Publication Data

US 2010/0236734 A1 Sep. 23, 2010

(30) Foreign Application Priority Data

Nov. 2, 2007 (GB) ..... 0721587.4

(51) Int. Cl.
*D21C 9/16* (2006.01)
*D21C 9/10* (2006.01)

(52) U.S. Cl.
CPC ..... *D21C 9/1042* (2013.01); *D21C 9/163* (2013.01)
USPC ..... 162/76; 162/78

(58) Field of Classification Search
CPC ..... D21C 9/16; D21C 9/163; D21C 9/166; D21C 9/1042
USPC ..... 162/76, 78
See application file for complete search history.

(56) References Cited

U.S. PATENT DOCUMENTS

| | | | | |
|---|---|---|---|---|
| 4,704,233 | A | 11/1987 | Hartman et al. | |
| 6,197,483 | B1 * | 3/2001 | Marrese et al. | 430/393 |
| 6,716,808 | B1 * | 4/2004 | Rohrbaugh et al. | 510/507 |
| 2010/0236734 | A1 | 9/2010 | Giles et al. | |

FOREIGN PATENT DOCUMENTS

| | | | |
|---|---|---|---|
| EP | 0141355 | A1 | 5/1985 |
| EP | 0509382 | A2 | 10/1992 |
| WO | 94/03553 | A1 | 2/1994 |
| WO | 97/30209 | A1 | 8/1997 |
| WO | WO 9730207 | A1 * | 8/1997 |
| WO | 99/27178 | A1 | 6/1999 |
| WO | 2007/085579 | A1 | 8/2007 |
| WO | WO 2007085579 | A1 * | 8/2007 |

OTHER PUBLICATIONS

Orama et al.,Complexation of [S,S] and mixed stereoisomers of N,N'-ethylenediaminedisuccinic acid (EDDS) with Fe(III), Cu(II), Zn(II), and Mn(II) ions, 2002, J. Chem. Soc., Dalton Trans., p. 4644-4648.*

Hyvonen et al., Studies on biodegradable chelating ligands:complexation of iminodisuccinic acid (ISA) with Cu(II), Zn(II), Mn(II), and Fe(III) ions in aqueous solution, 2003, Green Chemistry, 5, p. 410-414.*

Jones et al., Chemical speciation simulation used to assess the effiency of environment-friendly EDTA alternatives for use in the pulp and paper industry, 2002, Inorganica Chimica, p. 41-50.*

International Search Report dated May 20, 2009 for PCT/GB08/51027.

* cited by examiner

*Primary Examiner* — Anthony Calandra

(74) *Attorney, Agent, or Firm* — Burns & Levinson, LLP; Janine M. Susan

(57) ABSTRACT

A process for the bleaching of wood pulp using one or more peroxide oxidising agents wherein the process includes treatment of the pulp with a mixture of chelating agents comprising: (a) a first chelating agent selected from the group consisting of: ethylenediamine N,N-disuccinic acid, methylglycinediacetic acid, glutamic acid N,N-diacetic acid, imino disuccinic acid and anions and mixtures thereof; and (b) a second chelating agent selected from the group consisting of: diethylene triamine pentaacetic acid, ethylenediamine tetraacetic acid, diethylenetriamine penta methylene phosphonic acid and anions and mixtures thereof.

10 Claims, No Drawings

PROCESS FOR BLEACHING PULP

CROSS-REFERENCE TO RELATED APPLICATIONS

This application is a U.S. national stage application under 35 U.S.C. 371 of co-pending International Application No. PCT/GB08/51027 filed Nov. 3, 2008 and entitled "PROCESS FOR BLEACHING PULP", which in turn claims priority to Great Britain Patent Application No. 0721587.4 filed Nov. 2, 2007, both of which are incorporated by reference herein in their entirety for all purposes.

The present invention relates to a process for the bleaching of wood pulp. Wood pulp is used to make paper. Common processes for pulping wood include mechanical and chemical pulping.

Various types of mechanical pulp may be formed including stoneground wood pulp (SGW) in which grindstones embedded with silicon carbide or aluminium oxide are used to grind small wood logs; pressure ground wood pulp (PGW) in which wood is steamed prior to grinding; refiner mechanical pulp (RMP) in which wood chips are ground up with ridged metal discs known as refiner plates; and thermomechanical pulp (TMP) in which the chips are steamed whilst being refined.

To form a chemical pulp, wood chips are heated with chemicals to break down lignin in what is sometimes known as a delignification process.

A hybrid process is chemithermomechanical pulp (CTMP) in which wood chips are pretreated with mild chemicals prior to refining by methods used in a standard mechanical mill. In this case the chemicals are not used to remove lignin but to make the fibres easier to refine.

It is also possible to prepare a recycled pulp out of waste paper and paper board.

Pulp prepared by any of these methods can be bleached to provide a white paper product. Traditionally chlorine has been used as a bleach but for environmental reasons alternative bleaching agents have been used in recent years including chlorine dioxide, oxygen, ozone and hydrogen peroxide.

The present invention relates in particular to bleaching processes involving peroxide species. Peroxides are used in the bleaching stage of the pulp treatment, also known as the 'P' stage. In some cases there is an earlier chelating step which is known as the 'Q' stage.

Peroxide may be degraded by reaction with metal ions, which can lead to inefficient bleaching. It is therefore common to add a chelating agent to bind to metal ions. A problem with this however is the environmental impact that traditional non-biodegradable chelating species have.

One commonly used and very effective chelating agent is diethylene triamine pentaacetic acid (or DTPA). Another useful chelating agent is ethylenediamine tetraacetic acid (or EDTA). Phosphonate-based chelants, for example diethylenetriamine-penta-methylene phosphonic acid (DETPMP) are also commonly used effective chelating agents. However because these species are not degraded or removed during conventional waste water treatment, large quantities are now found in European surface waters. The presence of these chelating agents has the potential to remobilise heavy metals from river sediments and treated sludges. High concentrations of the chelating agents inhibit plankton and algae growth and are toxic to bacteria.

One possible alternative chelating agent is the biodegradable ethylenediamine-N,N'-disuccinic acid (or EDDS) which when present as the [S,S] enantiomer is readily biodegradable.

Other biodegradable chelating agents include methylglycine diacetic acid (MGDA), glutamic acid, N,N-diacetic acid (GLDA) and imino disuccinic acid (IDS).

Surprisingly, the present inventors have found that the use of a combination of certain biodegradable chelating agents with selected non-biodegradable chelating agents shows improved performance when used in pulp bleaching processes, compared to what would be expected from the relative effectiveness of the individual chelating agents when used in similar amounts alone. Improved performance may be measured, for example, by increased residual peroxide levels at the end of the process, or by improved ISO brightness of the treated product, or by a reduction in the amount of the peroxide needed to achieve an equivalent bleaching effect.

According to a first aspect of the present invention, there is provided a process for the bleaching of wood pulp using one or more peroxide oxidising agents wherein the process includes treatment of the pulp with a mixture of chelating agents comprising:

(a) a first chelating agent selected from the group consisting of: ethylenediamine-N,N'-disuccinic acid, methylglycinediacetic acid, glutamic acid N,N-diacetic acid, imino disuccinic acid and anions and mixtures thereof; and (b) a second chelating agent selected from the group consisting of: diethylene triamine pentaacetic acid, ethylenediamine tetraacetic acid, diethylenetriamine penta methylene phosphonic acid and anions and mixtures thereof.

By anions and mixtures thereof we mean that each of components (a) and (b) may optionally contain one or more of the listed species and that the or each of those species may be present as an anion. The anion may be added to the mixture in the form of a salt.

Suitably the weight ratio of component (a) to component (b) is from 100:1 to 1:100, preferably from 50:1 to 1:50, more preferably from 20:1 to 1:20, preferably from 10:1 to 1:10, more preferably from 5:1 to 1:5, for example from 3:1 to 1:3.

Preferably the weight ratio of component (a) to component (b) is at least 1:1.

Preferably the weight ratio of component (a) to component (b) is from 50:1 to 1:1, preferably from 30:1 to 1:1, more preferably from 20:1 to 1:1, preferably from 15:1 to 1:1 for example from 12:1 to 1:1, more preferably from 10:1 to 1:1, preferably from 8:1 to 1:1, for example from 6:1 to 1.1:1, from 5:1 to 1.2:1 or from 4:1 to 1.5:1. The ratio may, for example, be between 12:1 and 2:1 or 10:1 and 1.5:1.

In some embodiments the mixture of chelating agents may comprise further chelating agents selected from those which are well known to the person skilled in the art. Preferably component (a) and component (b) together provide at least 70 wt % of the mixture of chelating agents, preferably at least 90 wt %, more preferably at least 95 wt %. Most preferably the mixture of chelating agents consists essentially of component (a) and component (b).

The mixture of chelating agents may suitably comprise from 1 to 99 wt % of component (a) and from 1 to 99 wt % of component (b).

The mixture of chelating agents preferably comprises from 50 to 99 wt % of component (a) and from 1 to 50 wt % of component (b).

Preferably the mixture of chelating agents comprises at least 25 wt % of component (a), preferably at least 40 wt %, for example at least 50 wt %, preferably at least 55 wt %, more preferably at least 60 wt %, preferably at least 65 wt % and most preferably at least 70 wt % of component (a).

The mixture of chelating agents may comprise up to 98 wt % of component (a), preferably up to 95 wt %, more preferably up to 92 wt %, preferably up to 90 wt %, for example up to 85 wt % or up to 80 wt % of component (a).

The mixture of chelating agents preferably comprises at least 2 wt % of component (b), more preferably at least 5 wt %, preferably at least 7 wt %, preferably at least 10 wt %, for example at least 15 wt % or at least 20 wt % of component (b).

The mixture of chelating agents suitably comprises up to 75 wt % of component (b), preferably up to 60 wt % for example up to 50 wt %, preferably up to 40 wt %, for example up to 35 wt %, most preferably up to 30 wt % of component (b).

In the definitions given in this specification, the amounts given refer to the weight of each component as measured as the equivalent free acid(s). However each of the chelating agents when present may be provided as the free acid or as a salt or a mixture of salts. In the case of a salt, the acid residue will be present as an anion. To obtain the weight of the equivalent free acid, the mass of any counterion is ignored and replaced with nominal proton(s).

The components of the mixture of chelating agents may be supplied in the form of, for example, commercially available solutions but the definitions given above refer only to the amount of active chelating agent that would remain if any such diluent were removed.

Ethylenediamine disuccinic acid (EDDS) has the structure shown in FIG. 1:

FIG. 1

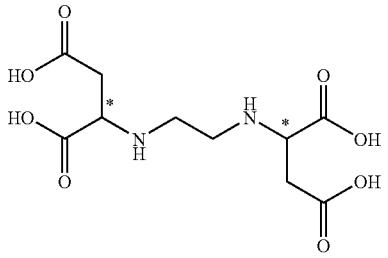

EDDS includes two stereogenic centres and there are three possible stereoisomers. A particularly preferred configuration is [S,S]-ethylenediamine disuccinic acid which is readily biodegradable.

Component (a) may include any of the stereoisomers. Thus it may include [R,R]-EDDS, [R,S]-EDDS, [S,S]-EDDS and any combination thereof.

Preferably when component (a) comprises EDDS, this is present as at least 50% [S,S]-EDDS, preferably at least 70%, more preferably at least 90%, most preferably at least 95 wt %, for example about 98 wt %. In some preferred embodiments all of the EDDS present in component (a) consists essentially of [S,S]-EDDS.

As detailed above, when component (a) comprises EDDS, this may be provided in a form having the structure shown in FIG. 1 or in a form having the same structure in which a number of the hydrogen atoms have been replaced. Thus component (a) may comprise EDDS salts in which 1, 2, or 4 of the acid groups have been neutralised or partially neutralised.

When a salt of EDDS is included, this may be the salt of an alkali metal, an alkaline earth metal, ammonia or a suitable amine.

When a monovalent counterion is used the salt may be the monosalt, the disalt, the trisalt or the tetrasalt. For a divalent cation the monosalt or disalt may be present. Mixed salts may also exist, for example, the disodium magnesium salt or the sodium magnesium salt may be present. Preferably the counterion(s) to the EDDS residue is/are selected from one or more of sodium, magnesium, calcium, potassium, lithium, ammonium, and a quaternary ammonium ion.

One commercially available material is trisodium ethylenediamine disuccinate, which is available under the trade mark Enviomet C140. Enviomet C140 is an aqueous solution comprising 30 wt % [S,S] EDDS (expressed as free acid) i.e. 37 wt % of trisodium EDDS (including the counterion).

Ethylenediamine disuccinic acid is also commercially available under the trade mark Enviomet C265. Enviomet C265 contains 65 wt % solid [S,S] EDDS as an acid, and water of crystallisation. This material is available in the form of a solid powder.

Preferably the EDDS is present as the trisodium salt.

Methylglycinediacetic acid (MGDA) has the structure shown in FIG. 2:

FIG. 2

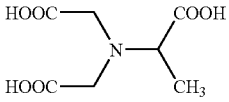

When component (a) comprises MGDA, this may be provided in a form having the structure shown in FIG. 2 or in a form having the same structure in which a number of the hydrogen atoms have been replaced. Thus component (a) may comprise salts in which 1, 2, or 3 of the acid groups have been neutralised or partially neutralised.

When a salt of MGDA is included, this may be the salt of an alkali metal, an alkaline earth metal, ammonia or a suitable amine.

When a monovalent counterion is used the salt may be the monosalt, the disalt or the trisalt. For a divalent cation the monosalt or disalt may be present. Mixed salts may also exist, for example, the sodium magnesium salt may be present. Preferably the counterion(s) to the MGDA residue is/are selected from one or more of sodium, magnesium, calcium, potassium, lithium, ammonium, and a quaternary ammonium ion.

When component (a) comprises MGDA or a salt thereof this may be present as either enantiomer or a mixture thereof. Preferably it is present as a racemic mixture.

MGDA is commercially available as a solution comprising 40 wt % of the trisodium salt and is sold under the trade mark Trilon M.

Glutamic acid N,N-diacetic acid (GLDA) has the structure shown in FIG. 3:

FIG. 3

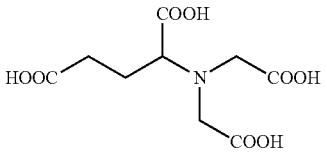

When component (a) comprises GLDA, this may be provided in a form having the structure shown in FIG. 3 or in a form having the same structure in which a number of the hydrogen atoms have been replaced. Thus component (a) may comprise salts in which 1, 2, 3 or 4 of the acid groups have been neutralised or partially neutralised.

When a salt of GLDA is included, this may be the salt of an alkali metal, an alkaline earth metal, ammonia or a suitable amine.

When a monovalent counterion is used the salt may be the monosalt, the disalt, the trisalt or the tetrasalt. For a divalent cation the monosalt or disalt may be present. Mixed salts may also exist, for example, the disodium magnesium salt or the sodium magnesium salt may be present. Preferably the counterion(s) to the GLDA residue is/are selected from one or more of sodium, magnesium, calcium, potassium, lithium, ammonium, and a quaternary ammonium ion.

When component (a) comprises GLDA or a salt thereof this may be present as either enantiomer or a mixture thereof. Preferably when component (a) comprises GLDA, at least 50% is present as [S]-GLDA, preferably at least 70%, more preferably at least 90%, most preferably at least 95 wt %, for example about 98 wt %. In some preferred embodiments all of the GLDA present in component (a) consists essentially of the S enantiomer.

GLDA is commercially available as a solution comprising 38 wt % of the tetrasodium salt and is sold under the trade mark Dissolvine GL-38.

Iminodisuccinic acid (IDS) has the structure shown in FIG. 4:

FIG. 4

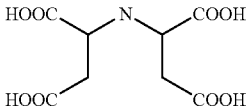

When component (a) comprises IDS, this may be provided in a form having the structure shown in FIG. 4 or in a form having the same structure in which a number of the hydrogen atoms have been replaced. Thus component (a) may comprise salts in which 1, 2, 3 or 4 of the acid groups have been neutralised or partially neutralised.

When a salt of IDS is included, this may be the salt of an alkali metal, an alkaline earth metal, ammonia or a suitable amine.

When a monovalent counterion is used the salt may be the monosalt, the disalt, the trisalt or the tetrasalt. For a divalent cation the monosalt or disalt may be present. Mixed salts may also exist, for example, the disodium magnesium salt or the sodium magnesium salt may be present. Preferably the counterion(s) to the IDS residue is/are selected from one or more of sodium, magnesium, calcium, potassium, lithium, ammonium, and a quaternary ammonium ion.

When component (a) comprises IDS or a salt thereof this may be present as either enantiomer or a mixture thereof. Preferably it is present as a racemic mixture.

IDS is commercially available as a solution comprising 34 wt % of the tetrasodium salt and is sold under the trade mark Baypure CX100.

As detailed above, component (a) may comprise a mixture of two or more of EDDS, MGDA, GLDA and IDS.

Preferably component (a) comprises EDDS and/or MGDA. Most preferably it comprises EDDS.

Preferably component (a) comprises at least 50 wt % of EDDS and/or MGDA, more preferably at least 70 wt %, preferably a least 90 wt %, for example at least 95 wt %. In some preferred embodiments, component (a) consists essentially of EDDS and/or MGDA.

Preferably component (a) comprises at least 50 wt % EDDS, more preferably at least 70 wt %, preferably a least 90 wt %, for example at least 95 wt %. In some preferred embodiments, component (a) consists essentially of EDDS.

DTPA has the structure shown in FIG. 5:

FIG. 5

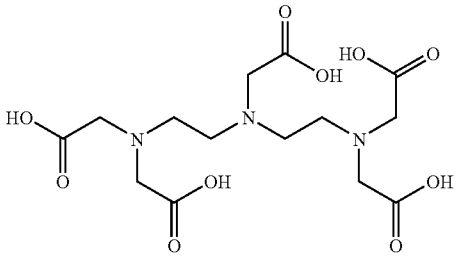

When component (b) comprises DTPA, this may be provided in a form having the structure shown in FIG. 5 or in a form having the same structure in which a number of the hydrogen atoms have been replaced. Thus component (b) may comprise salts in which 1, 2, 3, 4 or 5 of the acid groups have been neutralised or partially neutralised.

When a salt of DTPA is included, this may be the salt of an alkali metal, an alkaline earth metal, ammonia or a suitable amine.

When a monovalent counterion is used the salt may be the monosalt, the disalt, the trisalt, the tetra salt or the pentasalt. For a divalent cation the monosalt or disalt may be present. Mixed salts may also exist, for example, the disodium magnesium salt or the sodium magnesium salt may be present. Preferably the counterion(s) to the DTPA residue is/are selected from one or more of sodium, magnesium, calcium, potassium, lithium, ammonium, and a quaternary ammonium ion.

Preferably DTPA when present is present as the pentasodium salt.

EDTA has the structure shown in FIG. 6:

FIG. 6

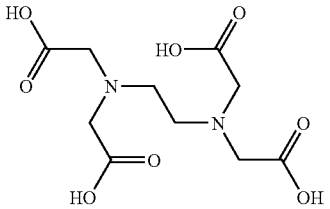

When component (b) comprises EDTA, this may be provided in a form having the structure shown in FIG. 4 or in a form having the same structure in which a number of the hydrogen atoms have been replaced. Thus component (b) may comprise salts in which 1, 2, 3 or 4 of the acid groups have been neutralised or partially neutralised.

When a salt of EDTA is included, this may be the salt of an alkali metal, an alkaline earth metal, ammonia or a suitable amine.

When a monovalent counterion is used the salt may be the monosalt, the disalt, the trisalt or the tetrasalt. For a divalent cation the monosalt or disalt may be present. Mixed salts may also exist, for example, the disodium magnesium salt or the sodium magnesium salt may be present. Preferably the counterion(s) to the EDTA residue is/are selected from one or more of sodium, magnesium, calcium, potassium, lithium, ammonium, and a quaternary ammonium ion.

Preferably EDTA when present is present as the tetrasodium salt.

DETPMP has the structure shown in FIG. 7:

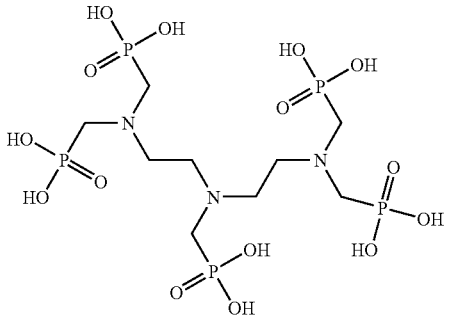

FIG. 7

When component (b) comprises DETPMP, this may be provided in a form having the structure shown in FIG. 4 or in a form having the same structure in which a number of the hydrogen atoms have been replaced. Thus component (b) may comprise salts in which 1, 2, 3, 4, 5, 6, 7, 8, 9 or 10 of the acid groups have been neutralised or partially neutralised.

When a salt of DETPMP is included, this may be the salt of an alkali metal, an alkaline earth metal, ammonia or a suitable amine.

When a monovalent counterion is used the salt may be the monosalt, the disalt, the trisalt, tetrasalt, pentasalt, hexasalt, heptasalt, octasalt, nonasalt or decasalt. For a divalent cation the monosalt, disalt, trisalt, tetrasalt or pentasalt may be present. Mixed salts may also exist, for example, the disodium magnesium salt or the sodium magnesium salt may be present. Preferably the counterion(s) to the DETPMP residue is/are selected from one or more of sodium, magnesium, calcium, potassium, lithium, ammonium, and a quaternary ammonium ion.

Preferably DETPMP when present is present as the heptasodium salt.

As detailed above, component (b) may comprise a mixture of two or more of DTPA, EDTA and DETPMP.

Preferably component (b) comprises DTPA and/or EDTA.

In the definitions given above the amount of component (b) refers to the total amount of DTPA, EDTA and DETPMP present.

In some embodiments component (b) comprises at least 50 wt % DTPA, preferably at least 70 wt %, for example at least 90 wt %. In some embodiments component (b) consists essentially of DTPA.

In some embodiments component (b) comprises at least 50 wt % EDTA, preferably at least 70 wt %, for example at least 90 wt %. In some embodiments component (b) consists essentially of EDTA.

In some embodiments component (b) comprises at least 50 wt % DETPMP, preferably at least 70 wt %, for example at least 90 wt %. In some embodiments component (b) consists essentially of DETPMP.

Suitably the process of the first aspect of the present invention involves the bleaching of wood pulp with one or more peroxide oxidising agents selected from hydrogen peroxide, organic peracids or a combination thereof. Organic peracids which may be used include peracetic acid.

The process of the present invention may comprise bleaching of a wood pulp selected from one or more of a mechanical pulp, a chemical pulp, a chemithermomechanical pulp or a recycled pulp, as described above.

The process of the present invention may be used with compositions having a wide range of pH values. For example the mixture of chelating agents could be added to a composition having a pH of between 1 and 12, for example between 2 and 10 or between 3 and 9.

In the process of the present invention the pulp may be treated with the mixture of chelating agents as defined above at any stage in the process. The process may include a step of treating the pulp with the mixture of chelating agents prior to the addition of the peroxide oxidising agent.

Alternatively and/or additionally, the process may include treating the pulp with the mixture of chelating agents during the bleaching step in which the peroxide oxidising agent is present.

A process for bleaching a pulp may include the addition of the mixture of chelating agents in a step prior to the addition of the peroxide bleaching agent and/or the addition of the mixture of chelating agents during the bleaching process in which the peroxide oxidising agent is present.

Treatment with the mixture of chelating agents may be carried out during the 'Q' stage and/or during the 'P' stage.

In the process of the present invention a mixture of chelating agents may be added as an aqueous solution to the pulp during the 'Q' stage and/or the 'P' stage.

The mixture of chelating agents may be added separately or together. They may be added neat or as a solution which further comprises a diluent.

According to a second aspect of the present invention there is provided a composition comprising:

(a) a first chelating agent selected from the group consisting of: ethylenediamine-N,N'-disuccinic acid, methylglycinediacetic acid, glutamic acid N,N-diacetic acid, imino disuccinic acid and anions and mixtures thereof; and (b) a second chelating agent selected from the group consisting of: diethylene triamine pentaacetic acid, ethylenediamine tetraacetic acid, diethylenetriamine penta methylene phosphonic acid and anions and mixtures thereof.

The preferred weight ratios of components (a) and (b) are preferably as defined in relation to the first aspect.

In some embodiments the composition of the second aspect consists essentially of components (a) and (b) and preferred features thereof are as those described for the mixture of chelating agents in relation to the first aspect.

In alternative embodiments, the composition comprises a diluent. Suitable diluents include water and alcohol.

In such embodiments, the composition of the second aspect preferably comprises from 0.5 to 80 wt %, preferably 10 to 60 wt %, more preferably 30 to 45 wt % of the mixture of chelating agents.

The invention also provides a concentrated precursor composition which may be diluted prior to use in the process of the first aspect.

According to a third aspect of the present invention, there is provided the use of a combination of:

(a) a first chelating agent selected from the group consisting of: ethylenediamine-N,N'-disuccinic acid, methylglycinediacetic acid, glutamic acid N,N-diacetic acid, imino disuccinic acid and anions and mixtures thereof; and (b) a second chelating agent selected from the group consisting of: diethylene triamine pentaacetic acid, ethylenediamine tetraacetic acid, diethylenetriamine penta methylene phosphonic acid and anions and mixtures thereof;

in a process for bleaching a wood pulp.

Preferred features of the third aspect are as defined in relation to the first and second aspects.

According to a fourth aspect of the present invention there is provided a bleached wood pulp obtained by the process of the first aspect of the present invention.

The invention also provides a bleached paper product formed from pulp bleached by the process of the present invention.

The process of the present invention provides significant advantages over processes in which only one of components (a) or (b) is used. Residual peroxide levels in the bleaching composition at the end of the process are higher than those obtained using only component (a) and the environmental benefits of using lower levels of component (b) are considerable.

Pulp bleached by the process of the present invention also has improved properties, for example it is brighter. A suitable method for determining brightness is ISO 3688: "Pulps—preparation of laboratory sheets for the measurement of diffuse blue reflectance factor (ISO brightness)".

For example, when measurements of residual peroxide levels or ISO brightness are taken, the present inventors have found that the results when using mixtures of chelating agents according to the present invention are superior to those that would be expected from a consideration of a weighted average of the results obtained using the individual components alone. Indeed, in some embodiments, the performance of the mixture has been found to be superior to that of either component when used individually.

The composition of the second aspect of the present invention is useful for stabilising peroxide species, in particular hydrogen peroxide. Thus the invention further provides the use of the composition of the second aspect to stabilise a peroxide oxidising agent. By stabilising we mean to refer to preventing, reducing and inhibiting degradation of the peroxide.

The use of the composition of the second aspect of the present invention in a pulp bleaching process may show superior bleaching performance compared to what would be expected from a consideration of the weighted average of the components when using an equivalent amount of hydrogen peroxide.

The use of the composition of the second aspect of the present invention in a pulp bleaching process may allow the same bleaching effect to be achieved using a lower level of peroxide than would be needed if an equivalent amount of either component (a) or component (b) alone were used in the process.

The invention will now be further defined with reference to the following non-limiting examples.

In these examples, the EDDS was supplied as the [S,S]-trisodium salt and the DTPA as the tetrasodium salt. EDTA was supplied as tetrasodium salt, MGDA was supplied as the trisodium salt, and DETPMP was supplied as the heptasodium salt. The weight ratios given refer to the amounts that would be present as the equivalent free acid. When dosages are given as Kg/tp, this refers to kilogrammes of active per tonne of dry pulp. CS (%) refers to the consistency of the pulp.

EXAMPLE 1

A chemical pulp having a Kappa Number of 10.1, a viscosity of 883 $dm^3$/Kg and a brightness 43.8% ISO was treated using a bleaching process.

Samples of the pulp were treated with 4 compositions as described in tables 1 and 2 which refer to the Q-stage and the P-stage.

TABLE 1

| Q-Stage | | | | |
|---|---|---|---|---|
| | A | B | C | D |
| Time (min) | 30 | 30 | 30 | 30 |
| Temperature (° C.) | 50 | 50 | 50 | 50 |
| CS (%) | 3 | 3 | 3 | 3 |
| Chelate (wt % DTPA) | 0 | 100 | 0 | 30 |
| Chelate (wt % EDDS) | 0 | 0 | 100 | 70 |
| Dosage Kg/tp (as active) | — | 1 | 1 | 1 |
| pH | 4 | 4 | 4 | 4 |

TABLE 2

| P-Stage | | | | |
|---|---|---|---|---|
| Time (hr) | 17 | 17 | 17 | 17 |
| Temperature (° C.) | 90 | 90 | 90 | 90 |
| CS (%) | 6 | 6 | 6 | 6 |
| H2O2 (Kg/tp) | 10 | 10 | 10 | 10 |
| pH | 10 | 10 | 10 | 10 |
| Residual $H_2O_2$ (ppm) | 35 | 476 | 102 | 500 |
| Brightness (% ISO) | 56.3 | 60.4 | 57 | 61 |
| Kappa | 6.7 | 6.2 | 6.3 | 6.2 |
| Viscosity (dm3/kg) | 863 | 883 | 817 | 879 |

It can be seen from the above results that the residual peroxide levels and ISO brightness observed for pulp D are greater than would have been expected from a consideration of the weighted average calculated on the basis of the results from pulp B and pulp C.

EXAMPLE 2

A mechanical ground wood pulp having a brightness of 58.3% ISO was treated in the P-stage as described in table 3.

TABLE 3

| P-Stage | | | | |
|---|---|---|---|---|
| | A | B | C | D |
| Chelate (wt % DTPA) | 0 | 100 | 0 | 30 |
| Chelate (wt % EDDS) | 0 | 0 | 100 | 70 |
| Dosage Kg/tp | — | 1 | 1 | 1 |
| Time (hr) | 90 | 90 | 90 | 90 |
| Temperature (° C.) | 90 | 90 | 90 | 90 |
| CS (%) | 6 | 6 | 6 | 6 |
| $H_2O_2$ (Kg/tp) | 52.5 | 52.5 | 52.5 | 52.5 |
| pH | 8 | 8 | 8 | 8 |
| Residual $H_2O_2$ (ppm) | 731 | 1182 | 1122 | 1258 |
| Brightness (% ISO) | 63.9 | 66.0 | 63.9 | 66.9 |

It can be seen from the above results that the residual peroxide levels and ISO brightness observed for pulp D are greater than would have been expected from a consideration of the weighted average calculated on the basis of the results from pulp B and pulp C.

EXAMPLE 3

A chemical pulp having a Kappa Number of 10.0, and a brightness 49.1% ISO was treated using a bleaching process.

Samples of the pulp were treated with 3 compositons as described in tables 4 and 5 which refer to the Q-stage and the P-stage.

TABLE 4

| Q-Stage | A | B | C |
|---|---|---|---|
| Time (min) | 30 | 30 | 30 |
| Temperature (° C.) | 50 | 50 | 50 |
| CS (%) | 7 | 7 | 7 |
| Chelate (wt % DTPA) | 100 | 0 | 30 |
| Chelate (wt % EDDS) | 0 | 100 | 70 |
| Dosage Kg/tp (as active) | 0.5 | 0.5 | 0.5 |
| pH | 7 | 7 | 7 |

TABLE 5

| P-Stage | | | |
|---|---|---|---|
| Time (hr) | 17 | 17 | 17 |
| Temperature (° C.) | 90 | 90 | 90 |
| CS (%) | 6 | 6 | 6 |
| H2O2 (Kg/tp) | 50 | 50 | 50 |
| pH | 11 | 11 | 11 |
| Residual $H_2O_2$ (ppm) | 85 | 51 | 85 |
| Brightness | 78.3 | 79.1 | 79.5 |

It can be seen from the above results that the residual peroxide levels and ISO brightness observed for pulp C are greater than would have been expected from a consideration of the weighted average calculated on the basis of the results from pulp A and pulp B.

EXAMPLE 4

A chemical pulp was treated using the following conditions:

Q-Stage Conditions

Consistency 3% pH=6.5

Temperature 65° C.

15 minutes

Chelant level at 0.1 kg/mt as 100% acid

P-Stage Conditions

Consistency 6%

35 kg/tp $H_2O_2$ as 100% active pH=11

17 hr at 80° C.

The results are shown in table 6.

TABLE 6

| Molar Ratio (EDDS/DTPA) | Brightness (ISO) |
|---|---|
| 100:0 | 83 |
| 90:10 | 85.3 |
| 75:25 | 84.7 |

These results show that the ISO brightness obtained when using a blend of chelating agents of the present invention is greater than when only EDDS is used.

EXAMPLE 5

A chemical pulp having a brightness 57.2% ISO was treated using a bleaching process. Samples of the pulp were treated with compositions as described in tables 7 and 8 which refer to the Q-stage and the P-stage.

TABLE 7

| Q-Stage | A | B | C |
|---|---|---|---|
| Time (min) | 45 | 45 | 45 |
| Temperature (° C.) | 85 | 85 | 85 |
| CS (%) | 4.5 | 4.5 | 4.5 |
| Chelate (wt % EDTA) | 100 | 0 | 25 |
| Chelate (wt % EDDS) | 0 | 100 | 75 |
| Dosage Kg/tp (as active) | 1 | 1 | 1 |
| pH | 7.5 | 7.5 | 7.5 |

TABLE 8

| P-Stage | A | B | C |
|---|---|---|---|
| Time (hr) | 2.5 | 2.5 | 2.5 |
| Temperature (° C.) | 85 | 85 | 85 |
| CS (%) | 20 | 20 | 20 |
| $H_2O_2$ (Kg/tp) | 40 | 40 | 40 |
| pH | 11 | 11 | 11 |
| Brightness | 75.7 | 74.3 | 75.7 |

It can be seen from the above results that the ISO brightness observed for pulp C is greater than would have been expected from a consideration of the weighted average calculated on the basis of the results from pulp A and pulp B.

EXAMPLE 6

A chemical pulp having a brightness 57.2% ISO was treated using a bleaching process. Samples of the pulp were treated with compositions as described in tables 9 and 10 which refer to the Q-stage and the P-stage.

TABLE 9

| Q-Stage | A | B | C |
|---|---|---|---|
| Time (min) | 45 | 45 | 45 |
| Temperature (° C.) | 85 | 85 | 85 |
| CS (%) | 4.5 | 4.5 | 4.5 |
| Chelate (wt % EDTA) | 100 | 0 | 32 |
| Chelate (wt % MGDA) | 0 | 100 | 68 |
| Dosage Kg/tp (as active) | 1 | 1 | 1 |
| pH | 7.5 | 7.5 | 7.5 |

TABLE 10

| P-Stage | A | B | C |
|---|---|---|---|
| Time (hr) | 2.5 | 2.5 | 2.5 |
| Temperature (° C.) | 85 | 85 | 85 |
| CS (%) | 20 | 20 | 20 |
| $H_2O_2$ (Kg/tp) | 40 | 40 | 40 |
| pH | 11 | 11 | 11 |
| Brightness | 75.7 | 73.8 | 75.8 |

It can be seen from the above results that the ISO brightness observed for pulp C is greater than would have been expected from a consideration of the weighted average calculated on the basis of the results from pulp A and pulp B.

EXAMPLE 7

A chemical pulp having a brightness 57.2% ISO was treated using a bleaching process. Samples of the pulp were treated with compositions as described in tables 11 and 12 which refer to the Q-stage and the P-stage.

TABLE 11

| Q-Stage | | | |
|---|---|---|---|
| | A | B | C |
| Time (min) | 45 | 45 | 45 |
| Temperature (° C.) | 85 | 85 | 85 |
| CS (%) | 4.5 | 4.5 | 4.5 |
| Chelate (wt % DTPA) | 100 | 0 | 39 |
| Chelate (wt % MGDA) | 0 | 100 | 61 |
| Dosage Kg/tp (as active) | 1 | 1 | 1 |
| pH | 7.5 | 7.5 | 7.5 |

TABLE 12

| P-Stage | | | |
|---|---|---|---|
| | A | B | C |
| Time (hr) | 2.5 | 2.5 | 2.5 |
| Temperature (° C.) | 85 | 85 | 85 |
| CS (%) | 20 | 20 | 20 |
| $H_2O_2$ (Kg/tp) | 40 | 40 | 40 |
| pH | 11 | 11 | 11 |
| Brightness | 76.1 | 73.8 | 75.4 |

It can be seen from the above results that the ISO brightness observed for pulp C is greater than would have been expected from a consideration of the weighted average calculated on the basis of the results from pulp A and pulp B.

EXAMPLE 8

A chemical pulp having a brightness 60.2% ISO was treated using a bleaching process. Samples of the pulp were treated with compositions as described in tables 13 and 14 which refer to the Q-stage and the P-stage. Example A is at 40 kg/mt $H_2O_2$ and Example B at 36 kg/mt.

TABLE 13

| Q-Stage | | |
|---|---|---|
| | A | B |
| Time (min) | 30 | 30 |
| Temperature (° C.) | 90 | 90 |
| CS (%) | 9 | 9 |
| Chelate (wt % DTPA) | 100 | 30 |
| Chelate (wt % EDDS) | 0 | 70 |
| Dosage Kg/tp (as active) | 1 | 1 |
| pH | 5.5 | 6.5 |

TABLE 14

| P-Stage | | |
|---|---|---|
| Time (hr) | 3 | 3 |
| Temperature (° C.) | 90 | 90 |
| CS (%) | 12 | 12 |

TABLE 14-continued

| P-Stage | | |
|---|---|---|
| $H_2O_2$ (Kg/tp) | 40 | 36 |
| pH | 11 | 11 |
| Brightness | 85 | 85 |

The same brightness is observed at a lower peroxide level.

EXAMPLE 9

A mechanical pulp having a brightness 65.1% ISO was treated using a bleaching process. Samples of the pulp were treated with compositions as described in table 15 which refers to the P-stage.

TABLE 15

| P-Stage | | | |
|---|---|---|---|
| | A | B | C |
| Time (hr) | 4 | 4 | 4 |
| Temperature (° C.) | 65 | 65 | 65 |
| CS (%) | 15 | 15 | 15 |
| $H_2O_2$ (Kg/tp) | 35 | 35 | 35 |
| pH | 10 | 10 | 10 |
| Chelate (wt % DTPMP) | 0 | 100 | 33 |
| Chelate (wt % EDDS) | 100 | 0 | 67 |
| Dosage (kg/mt) | 1 | 1 | 1 |
| Brightness | 72.0 | 75.5 | 75.3 |

It can be seen from the above results that the ISO brightness observed for pulp C is greater than would have been expected from a consideration of the weighted average calculated on the basis of the results from pulp A and pulp B.

The invention claimed is:

1. A process for the bleaching of wood pulp using one or more peroxide oxidising agents wherein the process includes treatment of the pulp with a mixture of chelating agents comprising:

(a) from 60 to 95 wt % of a first chelating agent selected from the group consisting of: ethylenediamine-N,N'-disuccinic acid, methylglycinediacetic acid, glutamic acid N,N-diacetic acid, and imino disuccinic acid; and (b) from 5 to 40 wt % of a second chelating agent selected from the group consisting of: diethylene triamine pentaacetic acid, ethylenediamine tetraacetic acid, and diethylenetriamine penta methylene phosphonic acid.

2. The process according to claim 1 wherein component (a) comprises ethylenediamine-N,N'-disuccinic acid.

3. The process according to claim 1 wherein component (b) comprises diethylene triamine pentaacetic acid.

4. The process according to claim 1 which includes a step of treating the pulp with the mixture of chelating agents prior to the addition of the peroxide oxidising agent.

5. The process according to claim 1 which includes treating the pulp with the mixture of chelating agents during the bleaching step in which the peroxide oxidising agent is present.

6. A process for the bleaching of wood pulp using one or more peroxide oxidising agents wherein the process includes treatment of the pulp with a mixture of chelating agents comprising:

(a) from 60 to 95 wt % of a first chelating agent selected from the group consisting of: ethylenediamine-N,N'-disuccinic acid, methylglycinediacetic acid, glutamic acid N,N-diacetic acid, and imino disuccinic acid; and (b) from 5 to 40 wt % of a second chelating agent selected from the group consisting of: diethylene triamine pentaacetic acid, ethylenediamine tetraacetic acid, and diethylenetriamine penta methylene phosphonic acid;

whereby the one or more peroxide oxidising agents is present at a lower level than would be needed to achieve the same bleaching effect using an equivalent amount of component (a) or component (b) alone.

7. A process for the bleaching of wood pulp using one or more peroxide oxidising agents wherein the process includes treatment of the pulp with a mixture of chelating agents comprising:

(a) from 60 to 90 wt % of a first chelating agent selected from the group consisting of: ethylenediamine-N,N'-disuccinic acid, methylglycinediacetic acid, glutamic acid N,N-diacetic acid, and imino disuccinic acid; and (b) from 10 to 40 wt % of a second chelating agent selected from the group consisting of: diethylene triamine pentaacetic acid, ethylenediamine tetraacetic acid, and diethylenetriamine penta methylene phosphonic acid.

8. The process according to claim 1, wherein the process is performed at a pH of between 3 and 12.

9. The process according to claim 6, wherein the process is performed at a pH of between 3 and 12.

10. The process according to claim 7, wherein the process is performed at a pH of between 3 and 12.

* * * * *